US008328236B2

(12) United States Patent
Faehndrich et al.

(10) Patent No.: US 8,328,236 B2
(45) Date of Patent: Dec. 11, 2012

(54) FLOOR CONVEYOR WITH WHEEL ARMS

(75) Inventors: Rainer Faehndrich, Tangstedt (DE); Lars Hildebrand, Ellerbek (DE); Matthias Roder, Hamburg (DE)

(73) Assignee: Jungheinrich AG, Hamburg (DE)

( * ) Notice: Subject to any disclaimer, the term of this patent is extended or adjusted under 35 U.S.C. 154(b) by 708 days.

(21) Appl. No.: 12/507,617

(22) Filed: Jul. 22, 2009

(65) Prior Publication Data

US 2010/0038180 A1 Feb. 18, 2010

(30) Foreign Application Priority Data

Jul. 23, 2008 (DE) ..... 10 2008 034 614

(51) Int. Cl.
*B66F 9/075* (2006.01)

(52) U.S. Cl. ..... 280/755; 187/222; 187/232; 280/80.1; 180/209; 180/906

(58) Field of Classification Search ..... 187/222, 187/231, 232; 414/631; 280/755, 80.1, 81.1, 280/149.2; 180/209, 24.02, 906
See application file for complete search history.

(56) References Cited

U.S. PATENT DOCUMENTS

| | | | | |
|---|---|---|---|---|
| 3,531,137 | A * | 9/1970 | Ganz et al. | 280/638 |
| 5,722,511 | A | 3/1998 | Wakamiya | |
| 6,138,796 | A | 10/2000 | Herschel | |
| 6,199,665 | B1 | 3/2001 | Eilerman et al. | |
| 2005/0034929 | A1 | 2/2005 | West et al. | |

FOREIGN PATENT DOCUMENTS

| | | | |
|---|---|---|---|
| CA | 911 937 | A | 10/1972 |
| DE | 2658696 | | 6/1978 |
| DE | 10324458 | A1 | 12/2004 |
| EP | 1 502 895 | A1 | 7/2004 |
| EP | 1 905 725 | A1 * | 9/2006 |
| EP | 1 905 726 | A1 | 9/2006 |

* cited by examiner

*Primary Examiner* — Ruth Ilan
(74) *Attorney, Agent, or Firm* — Vidas, Arrett & Steinkraus P.A.

(57) ABSTRACT

A floor conveyor, with a frame on which a drive unit and a load unit are attached, the load unit having a load carrying means adjustable in its height, further with two parallel wheel arms which are adapted to be mounted on the outer sides of the frame, each wheel arm mounting one load wheel, and with means for reducing the distance of the wheel arms from each other, wherein a frame portion or a frame plate is fixedly connected to the frame on each outer side thereof, said frame portion or frame plate having an outer bearing surface and holes which result in a first hole pattern, wherein a wheel arm plate is connected to the wheel arms, which has first through bores resulting in a second hole pattern, and an inner bearing surface.

13 Claims, 6 Drawing Sheets

FLOOR CONVEYOR WITH WHEEL ARMS

CROSS-REFERENCE TO RELATED APPLICATIONS

Not applicable

STATEMENT REGARDING FEDERALLY SPONSORED RESEARCH

Not applicable

BACKGROUND OF THE INVENTION

The present invention is related to a floor conveyor with wheel arms.

In a certain type of floor conveyors, a pair of wheel arms is laterally attached to the frame of the floor conveyors, which bear load wheels at the front end. The wheel arms function to support the vehicle in the region of the load unit, i.e. to prevent the vehicle from being tilted towards the front.

In such floor conveyors, it is sometimes necessary to have a greater wheel gauge on the load side of the vehicle. For instance, when a pallet is to be taken out in a higher rack shelf level, but the wheel arms find no space on the floor into which they can advance, for instance because of a pallet standing transversely, it would be desirable to have a greater wheel gauge for the wheel arms. It is known to provide a respective wheel gauge for the wheel arms for special cases of utilisation. However, from this result changed requirements for the manufacture as well as for shipping as compared to standard vehicles of the same type. Such requirements are a materials expense, greater manufacturing expense as well as a more sumptuous assembly.

Different possibilities have already become known to change the wheel gauge of wheel arms in that the wheel arms are welded to the frame at different distances. However, this has the disadvantage that the wheel gauge can no more be changed afterwards and that due to the width, one has to deal with significantly more bulky vehicle frames in the manufacture and shipping. Moreover, wheel arms that are welded on are not replaceable when an error occurs, so that the entire vehicle frame is affected.

Another known possibility is realise the interface of the wheel arm in an adjustable manner, depending on the desired vehicle- or wheel gauge width, respectively. However, this has the disadvantage that the material for the broadest variant of the vehicle type must be present in the vehicle even at narrower vehicle models. Moreover, the adjustment of the accurate vehicle width is accompanied by an additional expense.

Finally, an individual type of wheel arm can be provided for different wheel gauges of a floor conveyor. Each of these wheel arm types can be installed on an interface on the vehicle frame or the lifting scaffold, respectively. This is disclosed in U.S. Pat. No. 6,138,796, the entire contents of which is incorporated herein by reference, for instance. However, in this realisation it is disadvantageous that two wheel arms are necessary for each demanded wheel gauge. This creates a high variance in the materials stockage.

The present invention is based on the objective to provide a floor conveyor which can be adjusted to different wheel gauges of the wheel arms with a small expense of material and installation.

The floor conveyor of this invention, with a frame on which a drive unit and a load unit are attached, the load unit having a load carrying means adjustable in its height, further with two parallel wheel arms which are adapted to be mounted on the outer sides of the frame, each wheel arm mounting one load wheel, and with means for reducing the distance of the wheel arms from each other, wherein a frame portion or a frame plate is fixedly connected to the frame on each outer side thereof, said frame portion or frame plate having an outer bearing surface and holes which result in a first hole pattern, wherein a wheel arm plate is connected to the wheel arms, which has first through bores resulting in a second hole pattern, and an inner bearing surface, wherein at least one pair of adapter blocks with third and fourth bearing surfaces and second through bores resulting in a third hole pattern is provided, first, second and third hole pattern being identical, wherein a first set of bolts for attaching the wheel arm plate on the frame portion or the frame plate and at least one second set of bolts for attaching the wheel arm plate on the frame portion or the frame plate by way of at least one adapter block at a time are provided, the first and second bearing surfaces bearing against each other or against the third or fourth bearing surface, respectively, of the adapter blocks.

BRIEF SUMMARY OF THE INVENTION

In the floor conveyor according to the present invention, a frame plate is fixedly attached to the frame on each outer side thereof. The frame plate has holes with a preset first hole pattern. Wheel arm plates are connected with the wheel arms, which feature through bores. The through bores result in a second hole pattern. Further, at least one pair of adapter blocks is provided with second through bores, which result in a third hole pattern. First, second and third hole pattern are identical. Wheel arm plate and frame plate as well as the adapter blocks bear against each other via first to fourth bearing surfaces. The adapter blocks have a preset length. Finally, two sets of bolts are provided in the invention, wherein each set has bolts of different lengths. The first set serves for the direct connection of frame- and wheel arm plate, whereas the second set serves for the connection of wheel arm plate and frame plate with an adapter block there between.

Instead of the wheel arm plate, a suitable, correspondingly thick portion of the frame wall may also be provided for attaching the wheel arms.

The bolts can be clamping bolts which find an abutment on the frame plate, whereas they have for instance a thread on the outer end, onto which a nut can be screwed up. However, threaded bolts are preferably provided, which are screwable into threaded bores of the frame plates, in order to fix the wheel arm plate on the frame plate without or with an adapter block.

One single interface is provided per side of the floor conveyor in the present invention. Further, there is only one single type of wheel arm in the invention, which on its part has an interface via which the wheel arm can be attached. In order to create different wheel gauges, the adapter block is mounted between the interface on the frame and the interface on the wheel arm. The adapter blocks of plural pairs can have different lengths, depending on the desired wheel gauge. However, it is also possible to provide a plurality of adapter blocks that are shorter, for instance, wherein the wheel gauge results from the number of the assembled adapter blocks. Thus, in the present invention it is not necessary to hold out individual wheel arm types for different wheel gauges, but only the respective adapter blocks for the arrangement between wheel arm plate and frame plate.

Wheel arm plates and frame plates and adapter blocks have bearing surfaces, as was mentioned above, which can be planar in an embodiment of the present invention. However, they may also allow a positive fit, which can contribute to a momentum transfer. The positive fit can be produced by a bayonet mount or through a connection by groove and tongue, by a toothed connection or by engagement of projections in recesses, or the like.

In contrast to fixedly welded wheel arms, in the present invention the same can be adjusted to the desired wheel gauge afterwards, by means of adapter pieces. Only the corresponding single component has to be replaced when a defect occurs. In contrast to freely adjustable wheel arms, only that amount of material is used up in the invention which is necessary for forming a desired wheel gauge. Also, sumptuous adjustment of the wheel gauge and of the alignment is avoided, because the adapter blocks can be fixed in their width and position with respect to the interface. However, according to a further embodiment of the invention, it is also possible to make the adapter blocks adapted to be varied telescopically in their length. In this case, means have to be provided to lock the adapter blocks in their respective adjusted length.

In the present invention, it is avoided to hold out different wheel arms, which remain always equal as the greatest part of the construction instead. The smallest gauge can be formed in that the wheel arms are fixed directly on the frame, i.e. e. without adapter blocks.

As the adapter blocks can be equal on both sides of the vehicle, only one realisation has to be provided.

As already mentioned, the sets of adapter blocks can feature pairs having different lengths, or the same length. The wheel arm plates are preferably laterally welded on the rear end of the wheel arms.

According to a further embodiment of the invention, at least two sets of shear bolts can be provided, which are adapted to be matchingly received by second bores of the wheel arm plates, the frame plates and the adapter blocks. The shear bolts serve for the improved transfer of the momentum from the wheel arms to the vehicle frame, but not for attaching the wheel arms.

The wheel arm plates and/or the adapter blocks can feature second threaded bores for receiving threaded puller pins. Pulling off is possibly necessary when shear bolts are used. These sit in the bores under pressure, so that a corresponding force has to be exerted for pulling off the adapter blocks or the wheel arm plates, respectively.

According to another embodiment of the present invention, the frame plates can feature a central recess. According to a further embodiment of the invention, the adapter blocks can be hollow bodies. The wall of the hollow adapter blocks facing the wheel arm plates can feature a recess. Thus, a better access can be obtained to the threaded bores for the puller pins.

BRIEF DESCRIPTION OF THE SEVERAL VIEWS OF THE DRAWINGS

An example of the realisation of the present invention is explained in more detail in drawings below.

DETAILED DESCRIPTION OF THE INVENTION

While this invention may be embodies in many different forms, there are described in detail herein a specific preferred embodiment of the invention. This description is an exemplification of the principles of the invention and is not intended t limit the invention to the particular embodiment illustrated In FIGS. 1 and 2, a frame 10 of a floor conveyor not shown in more detail is shown. The frame houses the drive means for the floor conveyor, as well as the not shown load unit. Wheel arms are arranged on both sides of the frame, only one wheel arm 12 being shown in FIGS. 1 and 2. Such wheel arms bearing mount a load wheel on the front end, which is not shown here, however. In the following, it is also made reference to the wheel arm 12 only, wherein it is self-understanding that the second not shown wheel arm is formed complementary.

Figure 2:
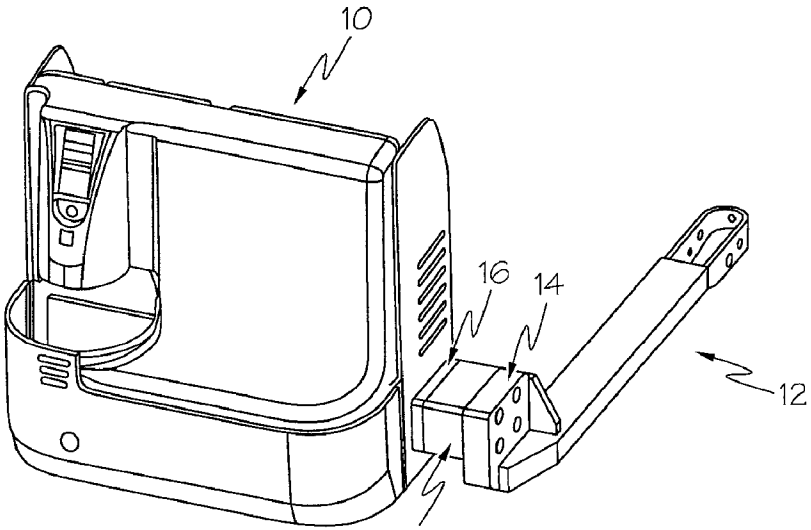
FIG. 2 shows the depiction of FIG. 1 with installed wheel arm.
Figure 1:
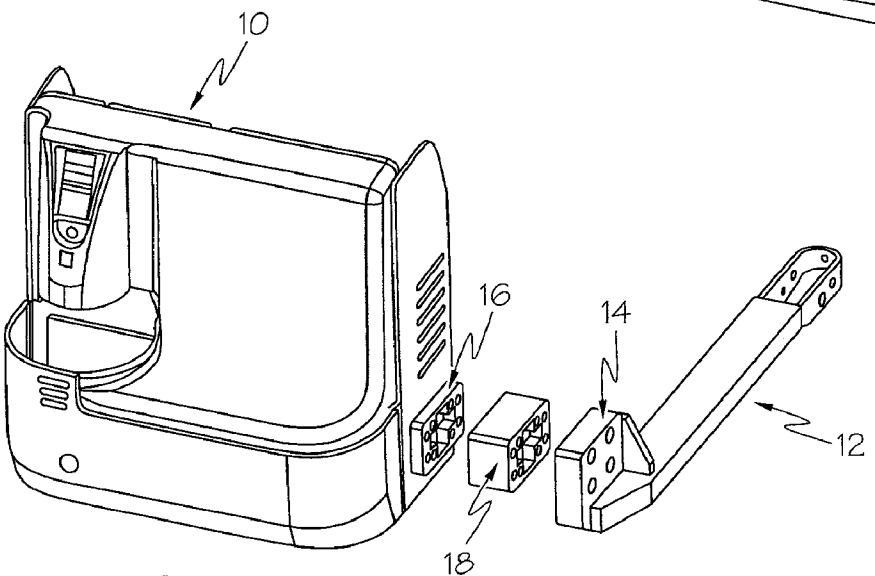
FIG. 1 shows the frame of a floor conveyor in a perspective view, with a wheel arm in an exploded view.
Figure 2A:
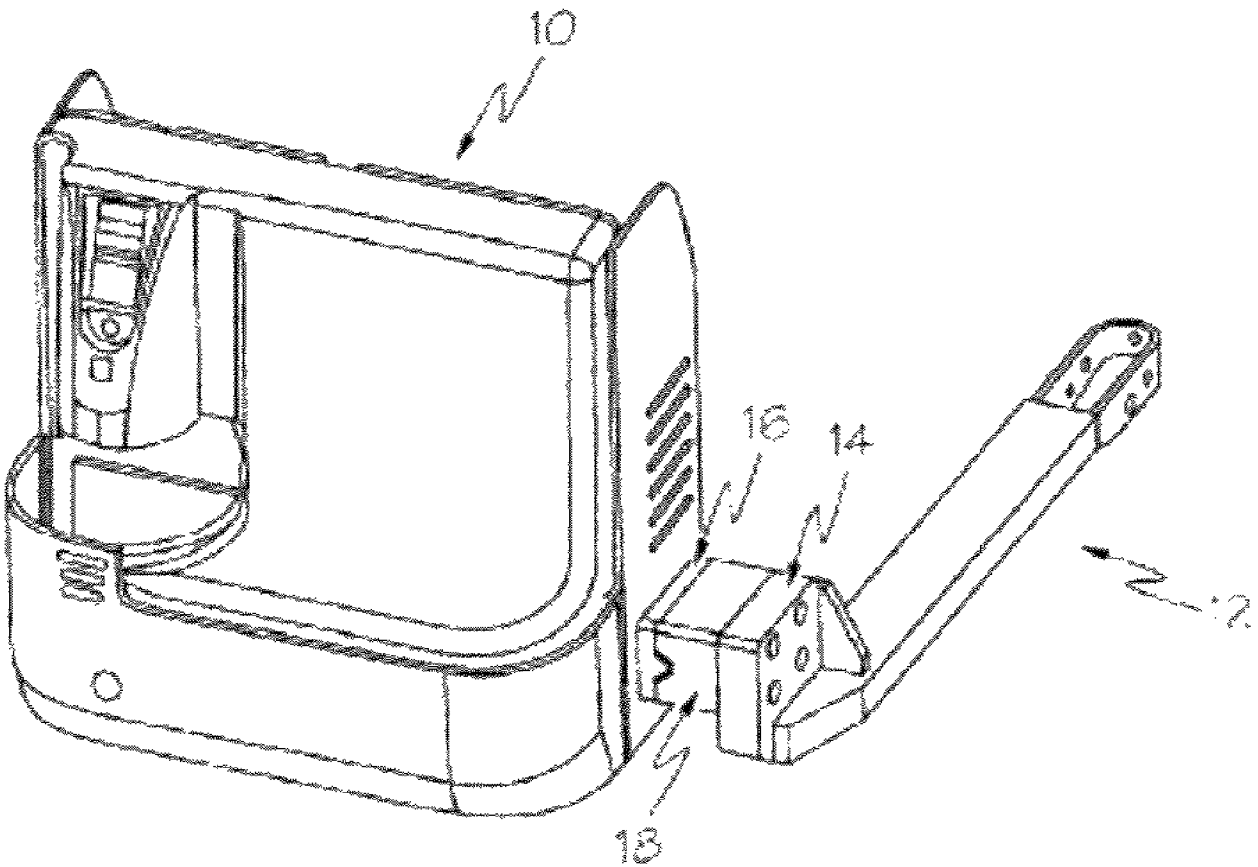
FIG. 2A shows an alternative embodiment of the depiction of FIG. 1 with an installed wheel arm.

In FIGS. 1 and 2 one recognises further that the wheel arm 12 has a wheel arm plate 14 on its rear end, which is attached by laterally welding it on the profile of the wheel arm 12. On the frame 10, i.e., on the lateral frame bodywork, a frame plate 16 is welded on in the lower region. In FIG. 2 one recognises how these component parts are linked with each other. The dimensions of the plates 14, 16 and those of the adapter block, respectively, define the distance of the wheel arms from each other.

Figure 3:
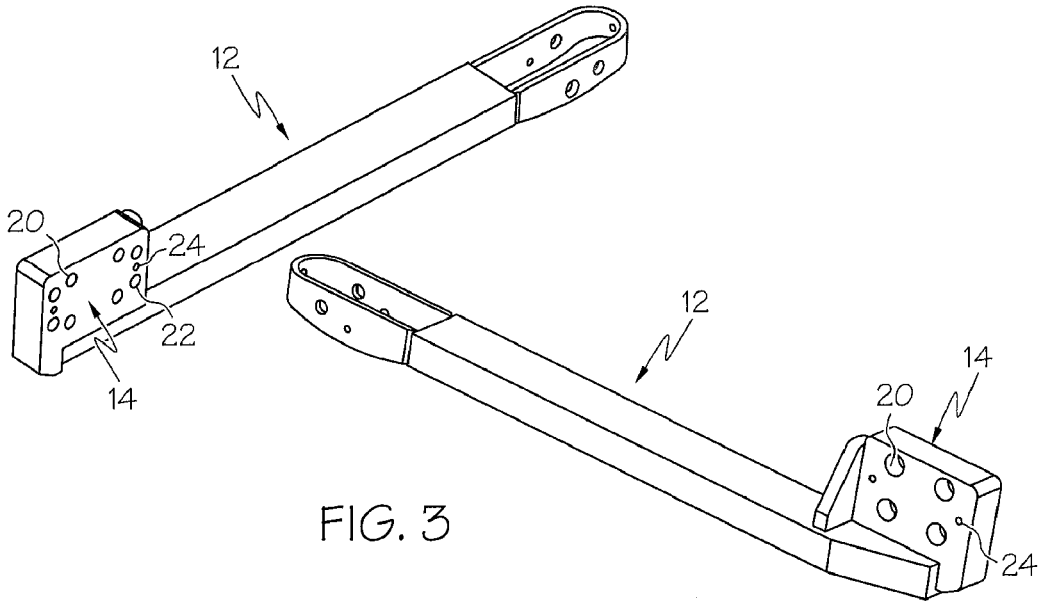
FIG. 3 shows the wheel arm of FIGS. 1 and 2 in two different views.

In FIG. 3 it can be recognised that the wheel arm 14 has first through bores 20. Second bores 22 are provided on the side facing the vehicle frame 10, which are no through bores, however. Finally, through bores 24 relatively small in diameter are provided, which feature a thread (not shown). Four at a time are provided of the bores 20 and 22, whereas two at a time are provided of the through bores 24. The bores 20 to 24 each respectively feature a preset hole pattern.

Figure 4:
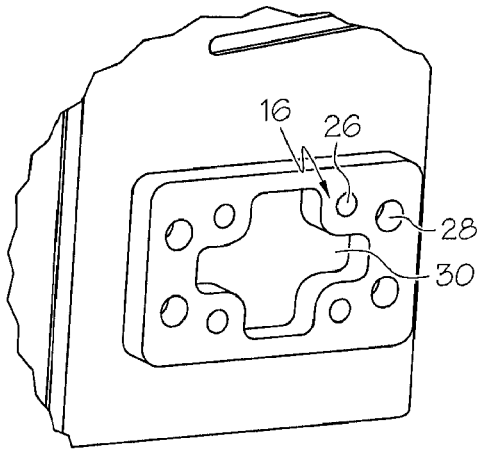
FIG. 4 shows the interface on the frame of FIG. 1 or FIG. 2, respectively, in a magnified view.

In FIG. 4, the frame plate 16 is pointed out in a magnified view. It features first bores 26 and second bores 28, which each one respectively result in a preset hole pattern. Between the bores 26, 28, the plate is provided with a cross-like recess 30. This serves for saving material. As can be recognised, the surfaces of the wheel arm plate 14 and the frame plate 16 that face each other are planar.

Figure 5:
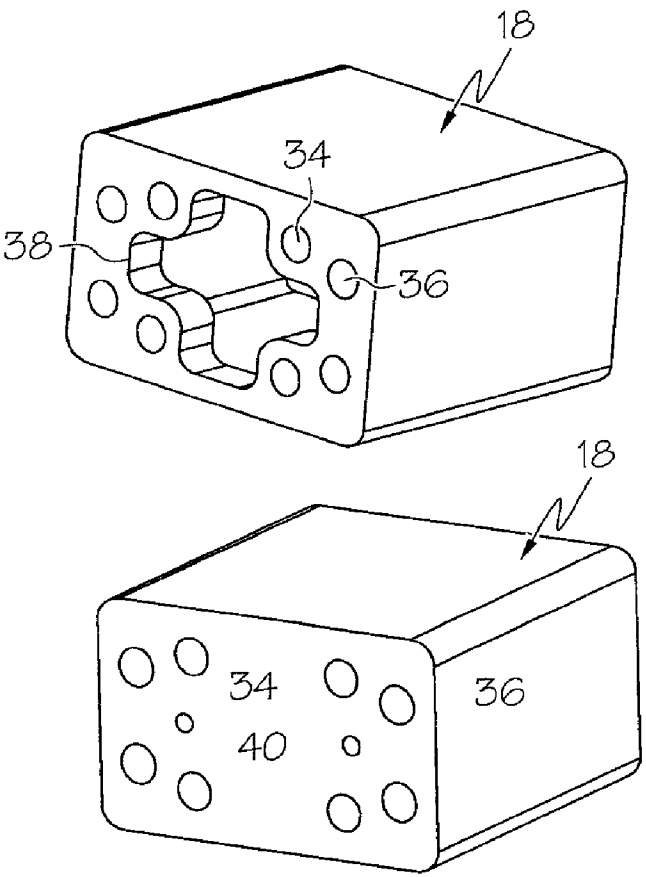
FIG. 5 shows a first adapter block in two perspective views.

In FIG. 5, the adapter block 18 is depicted in a magnified view. It features first bores 34 and second bores 36, each of which result in a certain hole pattern. The adapter block 18 is realised as a hollow body, its side 14 facing the wheel arm plate 14 having a cross-shaped recess 38. The rear wall is provided with threaded bores 40 smaller in diameter. In FIG. 5, one recognises also that the hole pattern of the bores 34, 36 is identical with the hole pattern of the bores 34, 36 on the rear side or the side facing the frame 10, respectively.

Figure 6:
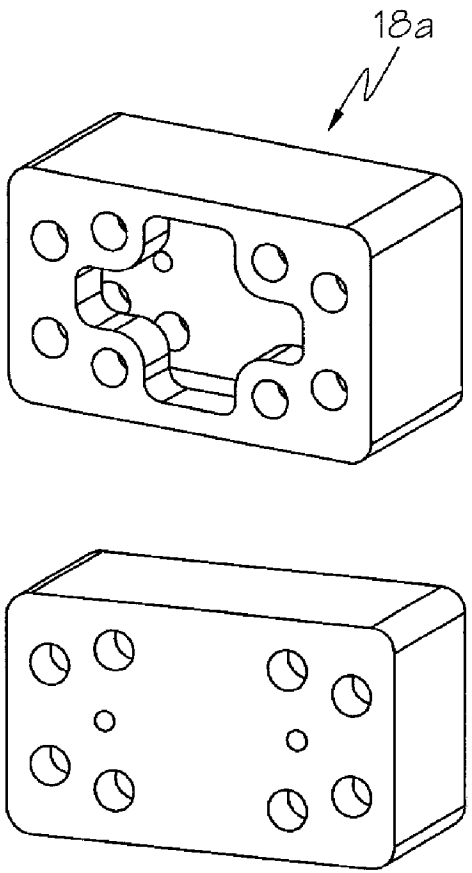
FIG. 6 shows a second adapter block in two perspective views.

An adapter block 18*a* can also be recognised in FIG. 6, which differs from that according to FIG. 5 only through its smaller length. For the rest, the hole pattern of the through bores is identical with that one of the adapter block 18, so that it will not be incurred on this further.

Figure 7:
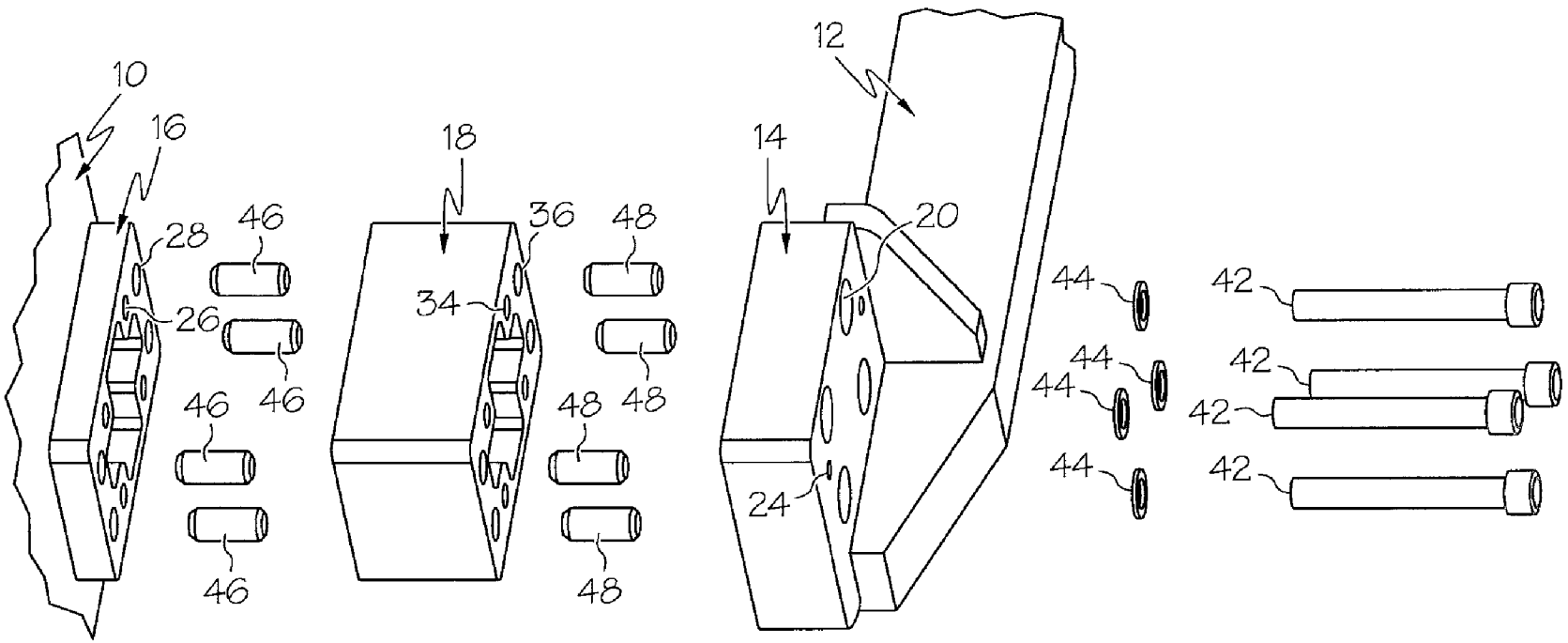
FIG. 7 shows the arrangement of the rear part of a wheel arm and the attachment possibility of the same on a frame plate of the frame with the aid of screw bolts, in a drawn apart view.

In FIG. 7, it is shown how the connection of the wheel arm with the frame shown in FIG. 2 takes place. In FIG. 7 one recognises four identical screw bolts 42 with a head on the end side, to which one disc 44 is associated at a time. The screw bolts are put into the through bores 20 of the wheel arm plate 14 and put through the through bores 34 of the adapter block 18, and screwed into the threaded bores 26 of the frame plate 16 with a thread portion at the end. Thus, the adapter block 12 can be fixedly connected to the frame 10. The screw heads are preferably sunk in the bores 20. The distance of the wheel arm 12 from the side of the frame 10 is determined by the thickness of the plates 16, 14 and the length of the adapter block 18. First locking sleeves 46 sit in the bores 28 of the frame plate 16 and in the bores 36 of the adapter block 18. Second locking sleeves 48 sit in the bores 36 of the adapter block 18 and the bores 22 of the wheel arm plate 14. The locking sleeves 46, 48 serve for receiving the momentum between wheel arm 12 and frame 10. They sit in the associated bores under pressure, so that the adapter block 18 and the wheel arm plate 14, respectively, can be separated from each other with the aid of not shown puller pins, which are screwed into the bores 24 or into the bores 40, respectively (FIG. 5).

Figure 8:
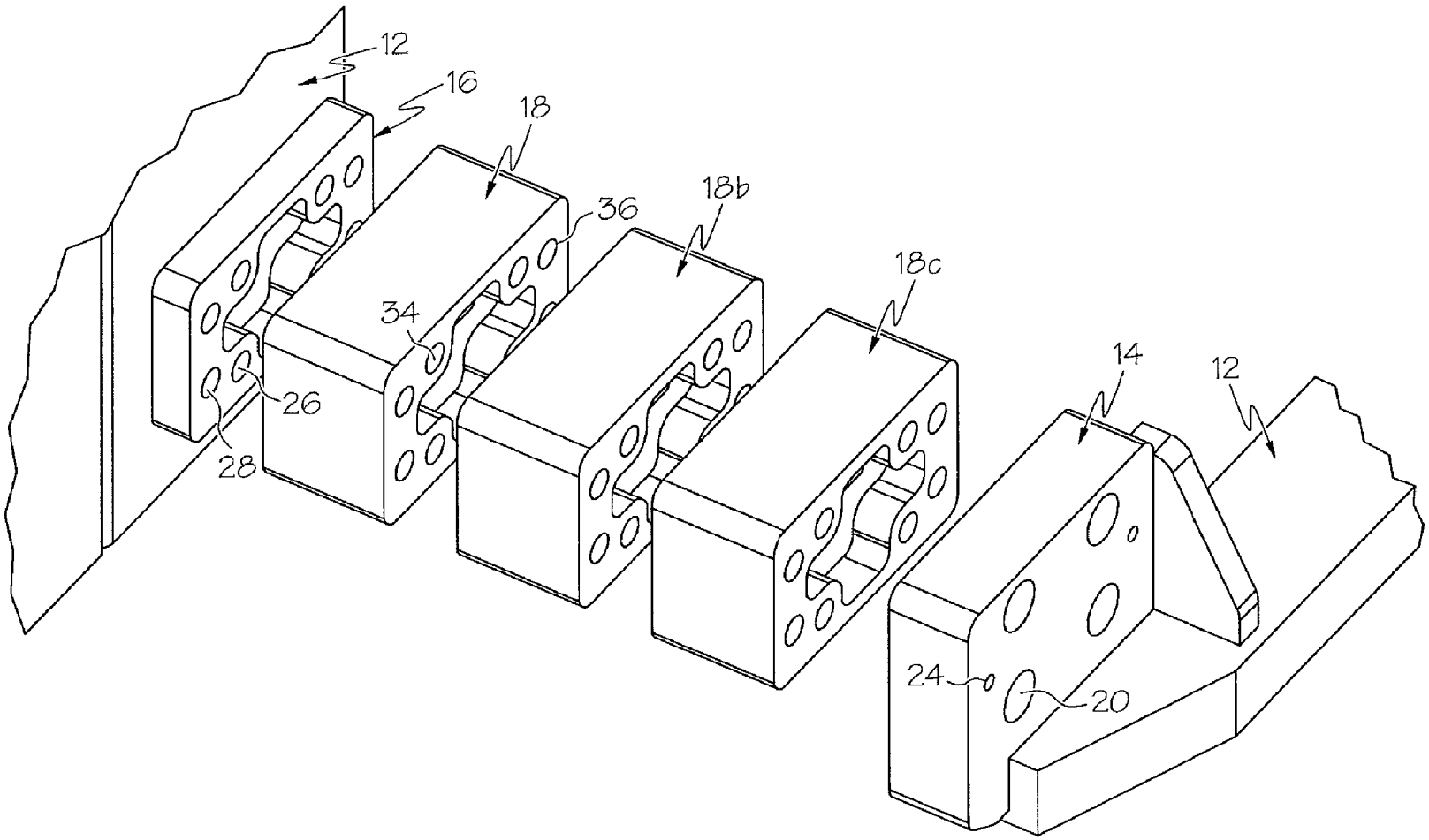
FIG. 8 shows an exploded perspective view for the adjustment of another wheel gauge of the wheel arms.

In FIG. 8 it can be recognised how the wheel gauge of wheel arms 12 can be changed by three adapter blocks 18*a*, 18*b*, 18*c*. It is obvious that the adapter blocks 18 to 18*c* can also have different lengths, or may be relatively short, respectively, in order to perform a fine tuning according to desire. With respect to the construction of the adapter blocks 18*b* and 18*c* it must be noted that it is the same as that of the block 18. In FIG. 8, the connection bolts are not shown, and also not the locking sleeves according to FIG. 7.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A floor conveyor, with a frame on which a drive unit and a load unit are attached, the load unit having a load carrying means adjustable in its height, further with two parallel wheel arms which are adapted to be mounted on the outer sides of the frame, each wheel arm mounting one load wheel, and wherein the distance of the wheel arms from each other is adjustable, characterised in that a frame portion or a frame plate (16) is laterally fixedly connected to the frame (10) on each outer side thereof, said frame portion or frame plate having an outer bearing surface and holes (26) which result in a first hole pattern, that a wheel arm plate (14) is connected to the wheel arms (12), which has first through bores (20) resulting in a second hole pattern, and an inner bearing surface, that at least one pair of adapter blocks (18*a*, 18*b*, 18*c*) with third and fourth bearing surfaces and second through bores (34) resulting in a third hole pattern is provided, wherein the first, second and third hole pattern are identical, that a first set of bolts for attaching the wheel arm plate (14) on the frame portion or the frame plate (16) and at least one second set of bolts (42) for attaching the wheel arm plate on the frame portion or the frame plate by way of at least one adapter block (18) at a time are provided, wherein the outer bearing surface and inner bearing surface bear against each other or against the third or fourth bearing surface, respectively, of the adapter blocks (18).

2. A floor conveyor according to claim 1, characterised in that the first set of bolts or the at least one second set of bolts (42) are screw bolts and the holes (26) of the wheel arm plate (16) feature a thread.

3. A floor conveyor according to claim 1, characterised in that the bearing surfaces are planar.

4. A floor conveyor according to claim 1, characterised in that the bearing surfaces engage positively and transfer a momentum from the wheel arms to the frame.

5. A floor conveyor according to claim 1, characterised by a set of pairs of adapter blocks, (18, 18*a*, 18*b*, 18*c*), the pairs having the same or different lengths.

6. A floor conveyor according to claim 1, characterised in that the wheel arm plates (14) are laterally welded to the rear end of the wheel arms (12).

7. A floor conveyor according to claim 1, characterised in that a set of shear bolts is provided, which are adapted to be matchingly received by second bores (22) of the wheel arm plates (14), the frame plates (16) and the adapter blocks (18).

8. A floor conveyor according to claim 7, characterised in that the wheel arm plates (14) and/or the adapter blocks (18, 18*a*, 18*b*, 18*c*) feature second threaded bores (24, 40) for receiving threaded puller pins.

9. A floor conveyor according to claim 1, characterised in that the frame plates (16) feature a central recess (30).

10. A floor conveyor according to claim 1, characterised in that the adapter blocks (18, 18*a*, 18*b*, 18*c*) are hollow bodies.

11. A floor conveyor according to claim 10, characterised in that the walls of the adapter blocks facing the wheel arm plates (14) feature a recess (38).

12. A floor conveyor according to claim 1, characterized in that the adapter blocks are adapted to be varied telescopically in their length and to be locked in the respective length.

13. An industrial truck comprising:

a frame (10) to which a drive part and a load part are attached, wherein the load part has a load receiving portion movable in height, two parallel wheel arms (12) that are attached to the outside of the frame, wherein each wheel arm supports a load wheel, wherein the spacing between the wheel arms is adjustable, and wherein each wheel arm has welded laterally to the rear end a wheel arm plate (14) with first through bore holes (20) that yield a second hole pattern and have an inner contact surface;

a frame plate (16) welded onto each outside at the lateral frame sheet metal (10) that has an outer contact surface and holes (26), which yield a first hole pattern;

at least one pair of adapter blocks (18*a*, 18*b*, 18*c*) with third and fourth contact surfaces and second through bores (34), which yield a third hole pattern;

wherein the first, second, and third hole patterns are identical;

a first set of bolts for fastening the wheel arm plate (14) to the frame plate (16);

at least a second set of bolts (42) for fastening the wheel arm plate to the frame plate via, in each case, at least one adapter block (18); and wherein the inner contact surface and outer contact surface rest against each other or on the third or fourth contact surface of the adapter blocks (18).

* * * * *